United States Patent [19]

Lewbart

[11] Patent Number: 4,641,672

[45] Date of Patent: Feb. 10, 1987

[54] APPARATUS FOR CLEANING DISH-LIKE OBJECTS

[75] Inventor: Harry M. Lewbart, Atco, N.J.

[73] Assignee: Campbell Soup Company, Camden, N.J.

[21] Appl. No.: 707,831

[22] Filed: Mar. 4, 1985

[51] Int. Cl.[4] ..... B08B 3/02

[52] U.S. Cl. ..... 134/62; 134/70; 134/127; 198/402

[58] Field of Search ..... 134/48, 49, 62, 69, 134/72, 77, 102, 125, 127, 133, 137, 152, 165, 68, 70, 134; 198/405, 417, 832, 402

[56] References Cited

U.S. PATENT DOCUMENTS

| | | | |
|---|---|---|---|
| 564,163 | 7/1896 | Schaake . | |
| 1,810,511 | 6/1931 | Wolfinger | 134/62 |
| 2,119,596 | 6/1938 | Mintert et al. | 198/405 |
| 2,671,241 | 3/1954 | Starner | 134/72 X |
| 3,190,298 | 6/1965 | Faller et al. | 134/125 |
| 3,486,939 | 12/1969 | Pinckard | 134/62 |
| 3,520,726 | 7/1970 | Gay | 134/115 R X |
| 3,675,665 | 7/1972 | Sadwith | 134/49 X |
| 3,767,028 | 10/1973 | Rosso | 198/405 |
| 3,768,493 | 10/1973 | Kraeft | 134/62 X |
| 4,104,081 | 8/1978 | Totten | 134/23 |
| 4,170,241 | 10/1979 | Clapp | 134/83 |
| 4,324,265 | 4/1982 | Fauth | 134/198 X |

FOREIGN PATENT DOCUMENTS

| | | | |
|---|---|---|---|
| 1001979 | 12/1976 | Canada | 198/405 |
| 1956050 | 11/1969 | Fed. Rep. of Germany | 134/62 |

*Primary Examiner*—Harvey C. Hornsby
*Assistant Examiner*—Frankie L. Stinson
*Attorney, Agent, or Firm*—Albert L. Free

[57] ABSTRACT

Plates destined to receive frozen dinners on them are washed automatically by apparatus which receives a train of horizontal plates, tilts the plates progressively upwardly to a more upright position as they move along a conveyor, applies sprays of cleaning and rinsing materials to them and dries them with warm air while they are moving along in that more upright position, and then progressively tilts the plates back to their horizontal positions as they continue to move along the conveyor. The tilting of the plates is accomplished by means of a twisted track serving as a guide along which the plates slide in response to moving belts frictionally engaging both sides of each plate as the plate executes its upwardly and downwardly tilting motions.

1 Claim, 8 Drawing Figures

APPARATUS FOR CLEANING DISH-LIKE OBJECTS

BACKGROUND OF THE INVENTION

This invention relates to apparatus for cleaning dish-like objects, and especially to such apparatus for washing and drying plastic trays or dishes on which meals to be frozen, packaged and sold are often placed.

Commonly, such dishes (often, and hereinafter, designated as "trays") must be thoroughly washed prior to use, preferably automatically so as to save the costs of hand-labor and to permit use of very hot water or other cleansing liquid. It is also important that they be in a more-or-less upright position at least while being dried and perferably also while being washed, to facilitate washing, draining and drying, and in certain applications it is desirable to convey them to and from the automatic washer and dryer in a horizontal position.

Automatic washers and dryers are known in which the trays are first manually stacked on edge in a special carrier; while in this position, cleansing solution is sprayed onto both sides of the upright trays, and drying air streams are thereafter applied to both sides of the trays to accelerate their drying. The upright cleansed and dried trays are then manually removed from the carrier and placed flat for subsequent handling. Such a system requires expensive hand-labor, or very elaborate equipment, to stack the trays upright prior to washing and drying, and to de-stack them into horizontal positions after washing and drying.

It is an object of the present invention to provide new and useful apparatus for the automatic cleaning of dish-like objects.

A further object is to provide such apparatus which accomplishes washing and drying of food trays.

Another object is to provide such apparatus which is effective, yet simple and reliable.

SUMMARY OF THE INVENTION

According to the invention, a conveyor system is provided which receives the dish-like objects in a horizontal position, one after the other in a moving series train, and which progressively tilts them into more upright positions as they continue to move along in the train; the conveyor means then tilts the objects gradually back to their horizontal positions as they move further along toward the output end of the conveyor. While the objects are in said more upright positions, they are automatically cleaned, preferably by washing and drying them while they are in their upright positions.

Preferably the apparatus comprises guide means in the form of a plurality of rails forming a twisted track for guiding said objects into and out of their more upright position as they slide along the tracks, and the objects are driven along the track by frictional engagement with a plurality of moving belts. Preferably also, the belts bear against both sides of the objects, while the objects are upwardly tilted; to accomplish this, two lower belts are preferably provided beneath the objects which move not only longitudinally but also vertically and sideways, following the objects, to maintain frictional contact with them; the top belt preferably passing across and frictionally engages the centers of the tops of the objects, at least while they are tilted upwardly from the horizontal positions.

BRIEF DESCRIPTION OF THE FIGURES

These and other features and advantages of the invention will be more readily appreciated from a consideration of the following detailed description, taken with the accompanying drawings, in which:

FIG. 6 is a sectional view taken along lines 6—6 of FIG. 1*a.

DETAILED DESCRIPTION OF PREFERRED EMBODIMENTS

Figure 1:
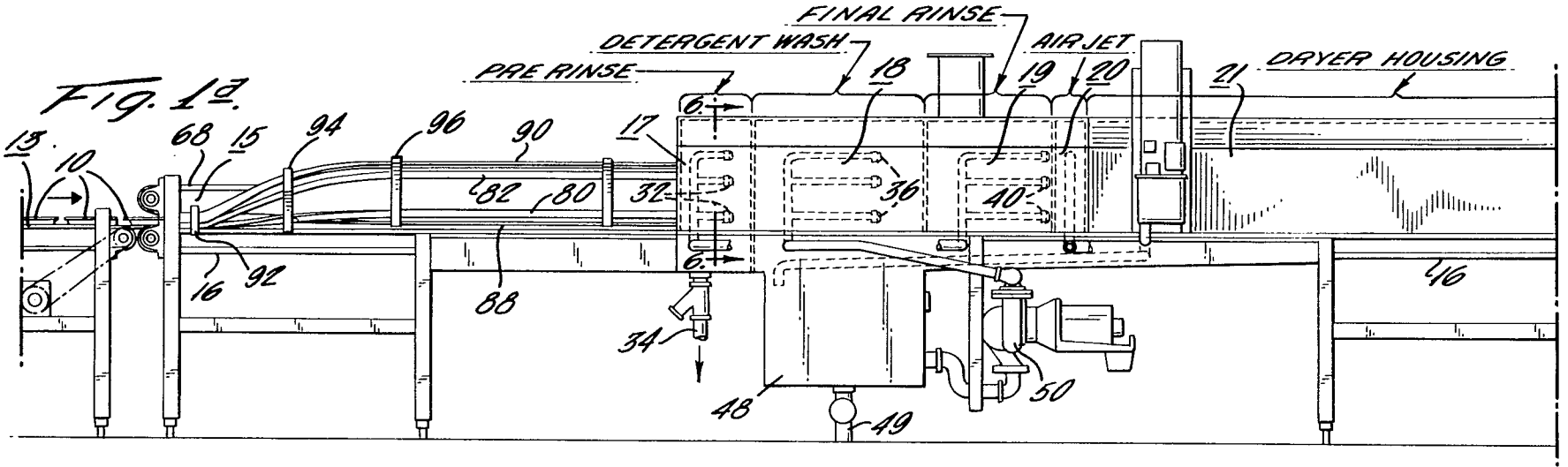
FIGS. 1*a* and 1*b* are somewhat schematic side elevational views of an automatic tray washing and drying system using the invention, 1*a* showing the input end and part of the central section, and FIG. 1*b* showing the remainder of the central section and the output end.
Figure 2:
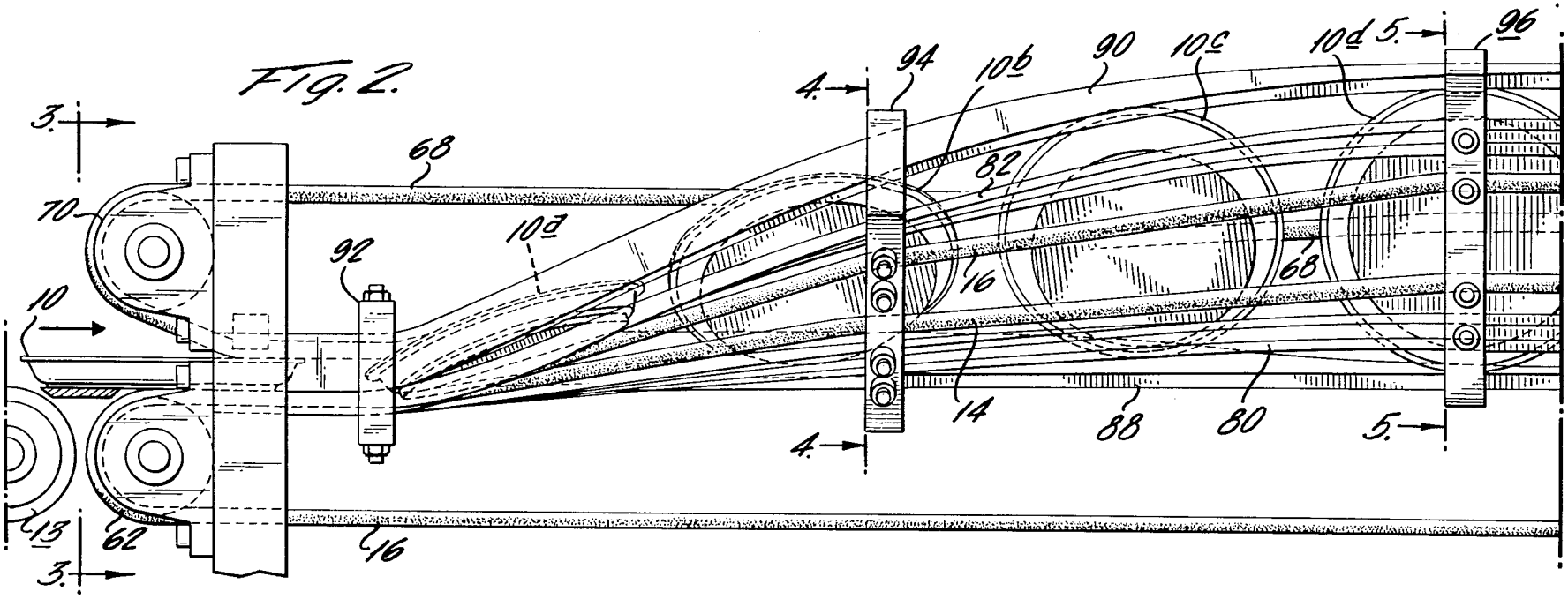
FIG. 2 is an enlarged view of the portion of FIG. 1*a* near its input end, with a train of trays moving through it.
Figure 16:
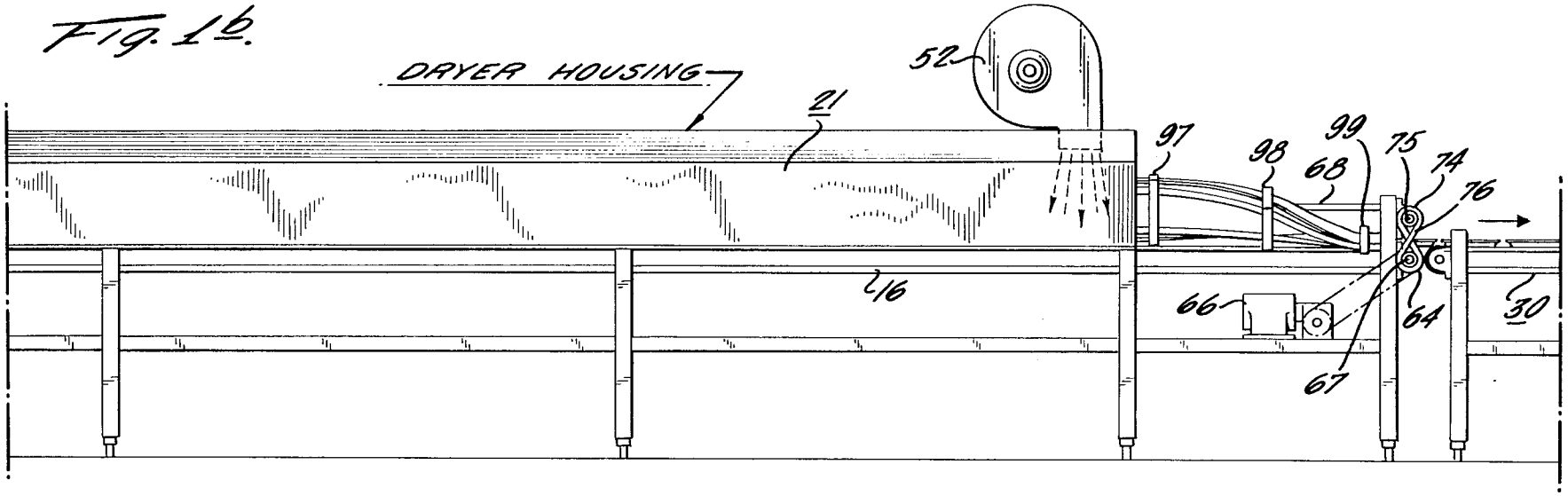

Referring now to the specific preferred embodiment of the invention shown in the drawings by way of illustration, and without thereby limiting the scope of the invention, the trays such as 10 are positioned one after the other in a series train, and are conveyed from left to right in FIGS. 1*a*, 1*b* and 2. Each tray may, for example, be circular, about 9 inches in diameter, and about $\frac{5}{8}$" deep, and may have a peripheral flange 12 about 3/16" in width around its top side. Typically each tray is made of an inert heat-resistant plastic material. At the left of FIG. 1 such trays are shown face-up in a horizontal position on a feed conveyor 13 and are delivered in this position onto two parallel longitudinally-extending endless belts 14 and 16 (see FIG. 3) of the input section 15 of the conveying system. In one application of the invention the trays will arrive at this position on the conveyor just after having come from a trimming operation, which removes rough edges from the trays but typically leaves them oily and dusty. They may be placed on the conveyor automatically or by hand, normally forming a regularly-spaced series train.

From this input section of the conveyor the belts 14 and 16 move the trays into and through the central section of the conveyor wherein they are tilted to more upward positions, pre-rinsed in a pre-rinser 17, washed in a detergent washer 18, given a final rinse in a final rinser 19, partially dried by an air jet system 20, and finally dried as they pass through a drier housing 21. After this, the trays are automatically returned to a horizontal position for delivery to a conveyor section 30 (FIG. 1*b*) which carries the trays to subsequent stations, for example for subsequent sterile packaging, if desired.

In this example the pre-rinse is provided by nozzles such as 32 directing a spray of water onto the opposite faces of each tray, the rinse water exiting through a drain pipe 34. The detergent wash is effected my means of nozzles such as 36, directing a cleansing solution such as detergent plus water onto both sides of the trays. The final rinse is accomplished by means of nozzles such as 40, which direct water onto both sides of the trays, with water drainage again provided through drain pipe 34. The detergent solution for the detergent wash may be stored in a reservoir 48 having a normally-closed convenience drain 49; a pump 50 circulates the detergent solution from the reservoir to the nozzles 36, whence it drains back into the reservoir. The pneumatic pressure for the air jets can be supplied from any convenient source of compressed air (not shown). The dryer housing 21 is exhausted of humid warm air by means of an exhaust fan 52; details of this arrangement are not relevant to the invention, hence are not shown.

The two lower drive belts 14 and 16 contacting the undersides of the trays (FIGS. 2 and 3) are in this example resilient, longitudinally-tensional endless belts of approximately circular cross-section, extending around rotatable sheaves such as 60 and 62 (FIG. 3) at the input end of the conveyor, and around a corresponding pair of rotatable sheaves such as 64 (FIG. 1*b*) at the output end of the conveyor. A drive motor 66 drives the common shaft 67 for the sheaves such as 64, thus serving to drive both of the lower belts 14 and 16. An upper endless belt 68 also extends the length of the conveyor, around input-end rotatable sheave 70 and output-end rotatable sheave 74, the latter of which is mounted on a drive shaft 75 driven by crossed-belt 76 to effect the desired motion of the belt 68.

Figure 7:
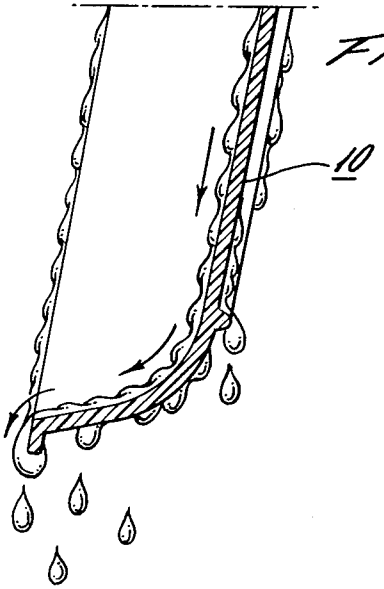
* and FIG. 7 is an enlarged fragmentary vertical sectional view of one of the trays being washed in the apparatus of FIG. 2.

As will be seen particularly clearly from FIG. 2 and the sectional views 3, 4 and 5, the trays such as 10*a*, 10*b*, 10*c* and 10*d* in FIG. 2 are progressively tilted upward in the sideways direction as they move through the initial portion of the central section of the conveyor, so as to achieve the nearly vertical position of tray 10*d* before reaching the pre-rinser 17. FIG. 7 shows the maximum upright position in this example, which is about 80° to the horizontal and sufficient to ensure that liquid will drain out of the tray by gravity flow.

Figure 3:
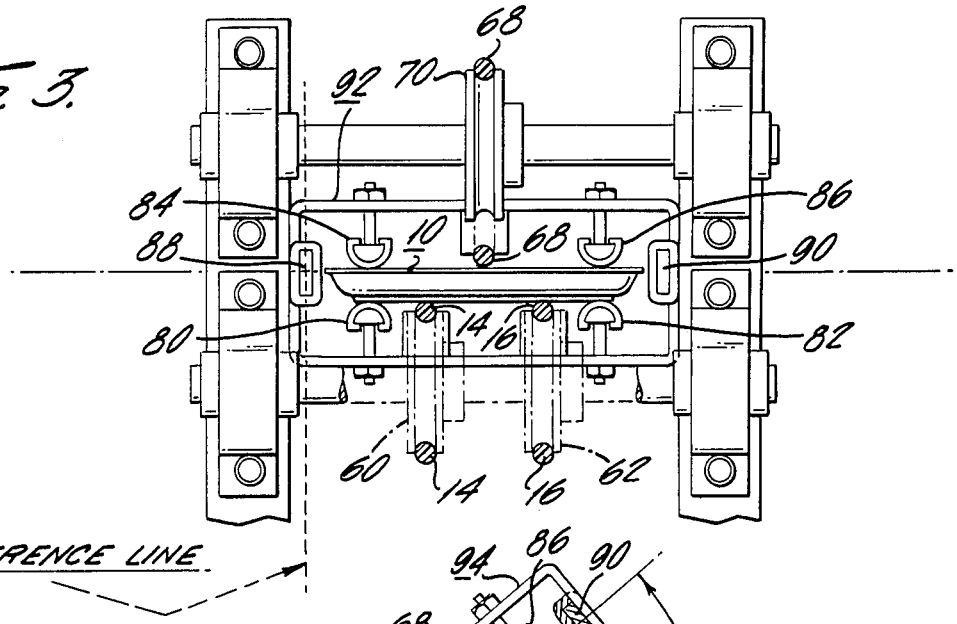
FIG. 3 is an end view of the apparatus of FIG. 2, as viewed along lines 3—3.
Figure 4:
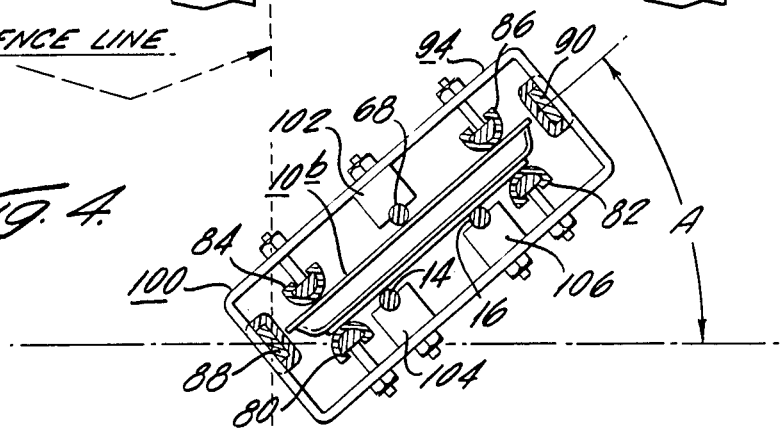
FIG. 4 is a sectional view taken along lines 4—4 of FIG. 2.
Figure 5:
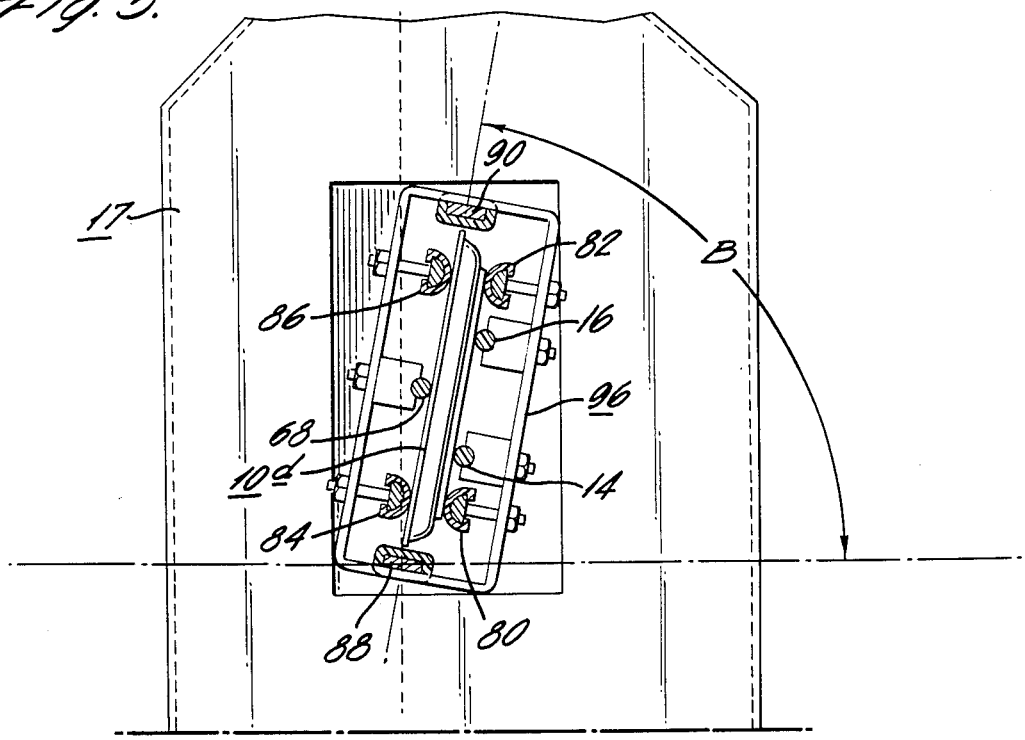
FIG. 5 is a sectional view taken along lines 5—5 of FIG. 2.

The angular position of a tray at any point is determined by the angular position of the guide track on which it slides in response to the drive belts. Thus as shown in FIG. 3, a pair of lower rails or guides 80,82 and a pair of upper rails or guides 84,86 initially support the trays in a horizontal position; further along, as shown in FIG. 4, the guide rails have gradually deviated to the position shown in which the tray is held at about a 45° angle A to the horizontal; and still further along, is shown in FIG. 5, the guide rails have deviated sufficiently that the tray is nearly vertical, in which position the rails and the tray remain until, near the output end of the conveyor, they return in a reverse progression, back to their original positions for which the trays are horizontal. Edge rails 88 and 90 extend adjacent the opposite side edges of the trays throughout the length of the conveyor to maintain lateral centering of the trays.

In order to hold the bottom belts 14 and 16 and the top belt 68 in frictional driving engagement with the trays during this tilting and untilting process, three belt guide block assemblies 92, 94 and 96 are provided at the input end of the conveyor to accommodate the upward tilting, and belt guide block assemblies 97, 98, and 99 are provided near the output end of the conveyor to accommodate the detilting of the trays. FIG. 4 shows a typical one of these guide block assemblies. It comprises a rectangular yoke 100 to which the top guide block 102 and the two bottom guide blocks 104 and 106 are secured by appropriate bolts and nuts. In this example, these guide blocks are stationary, and the belts slide longitudinally in the grooves of the blocks. The guide rails 80, 82, 84 and 86 are secured to the yoke by suitable nuts and bolts. The drive belts are taut, and of somewhat resilient material, as for example urethane, and the grooves of the guide blocks are sufficiently deep with respect to the cross-sections of the belts to prevent them from being pulled sideways out of the grooves.

Figure 6:
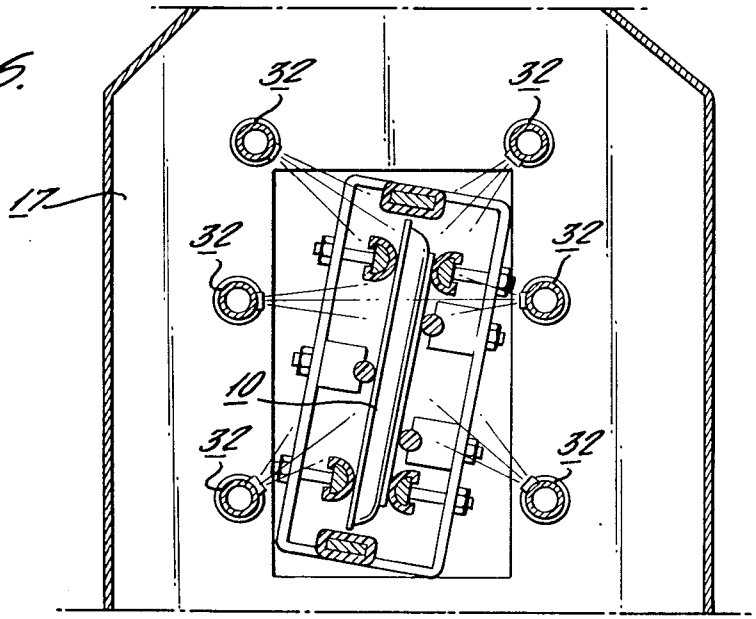

FIG. 6 shows a typical arrangement of the washing nozzles on each side of an upright tray as it passes through the detergent-wash section of the conveyor.

While the invention has been shown and described with particular reference to specific embodiments in the interest of complete definiteness, it may be embodied in any of a variety of forms diverse from those shown and described, without departing from the spirit and scope of the invention as defined by the appended claims.

What is claimed is:

1. Apparatus for cleaning dish-like objects having opposed major faces, comprising:

conveyor means having a first section for receiving dish-like objects placed thereon in horizontal positions to form a moving train of said objects, a second comprising means for receiving said train of objects from said first section and for turning them about axes parallel to the direction of motion from said horizontal positions to more upright positions and thereafter back again to horizontal positions as they move along a predetermined path in said second section, and a third section comprising means for receiving said objects from said second section while they are in said horizontal positions;

liquid-propulsion means for projecting cleansing liquid against both major faces of said objects as they pass through said second conveyor section in their more upright positions; and dryer means for directing a flow of air over both major faces of said objects as they move along in their more upright positions in said second section, downstream of said liquid-propulsion means;

said conveyor means comprising a plurality of stationary guide rails extending on both sides of said major faces of said objects and defining between them said path through said second section, a plurality of longitudinally-tensioned moving belts extending along both sides of said path for frictionally engaging said major faces of said objects to slide them along said path between said rails, and a plurality of stationary belt-positioning guide blocks spaced apart along said path and bearing against said belts to hold them in position against said objects, said belts being unsupported between said guide blocks and bearing against said major faces of said objects at positions between said blocks in response to lateral pressure exerted by said belt in response to the longitudinal tensioning of said belts; and (a) wherein said guide rails provide a track for said object which twists progressively from a horizontal position to a more upright position and then back to a horizontal position;

(b) wherein said belts engage both sides of said objects and comprise first and second belts which run horizontally beneath said objects in said first and third sections of said conveyor means and rise upwardly in the initial portion of said second section, travelling horizontally in the center portion of said second section, and returning downwardly in the downstream portion of said second section so as to maintain frictional contact with the underside of said object as it is tilted upwardly and downwardly;

(c) said belts comprising an upper belt running along the path of said conveyor means and bearing frictionally against the top major surfaces of said objects as they travel along said track in their upwardly-tilted positions;

(d) said upper belt passing across the centers of said objects; and (e) said belts covering only a minor portion of the sides of said objects to expose a major portion of said top sides to impact by said cleansing liquid.

* * * * *